US007619538B1

(12) United States Patent
Zarian

(10) Patent No.: US 7,619,538 B1
(45) Date of Patent: Nov. 17, 2009

(54) PROGRAMMABLE, DIRECTING EVACUATION SYSTEMS: APPARATUS AND METHOD

(75) Inventor: James R. Zarian, Corona del Mar, CA (US)

(73) Assignee: Sanrose, LLC, Corona del Mar, CA (US)

( * ) Notice: Subject to any disclaimer, the term of this patent is extended or adjusted under 35 U.S.C. 154(b) by 536 days.

(21) Appl. No.: 11/406,308

(22) Filed: Apr. 19, 2006

Related U.S. Application Data

(60) Provisional application No. 60/680,027, filed on May 12, 2005, now abandoned.

(51) Int. Cl.

| | |
|---|---|
| ***G08B 3/00*** | (2006.01) |
| ***G08B 5/00*** | (2006.01) |
| ***G08B 27/00*** | (2006.01) |
| ***G08B 17/10*** | (2006.01) |
| ***G08B 21/00*** | (2006.01) |
| ***G08B 1/08*** | (2006.01) |

(52) U.S. Cl. ..... 340/815.4; 340/326; 340/328; 340/330; 340/332; 340/628; 340/629; 340/630; 340/631; 340/632; 340/627; 340/539.1; 340/506; 340/517; 340/523

(58) Field of Classification Search ..... 340/326–332, 340/628–632, 815.4, 286.01, 286.02, 286.05, 340/539.1, 506, 517, 527
See application file for complete search history.

(56) References Cited

U.S. PATENT DOCUMENTS

| | | | | |
|---|---|---|---|---|
| 6,025,773 | A * | 2/2000 | Bresnan | 340/407.1 |
| 6,646,545 | B2 * | 11/2003 | Bligh | 340/286.05 |
| 6,778,071 | B2 * | 8/2004 | Megerle | 340/332 |
| 6,998,960 | B2 * | 2/2006 | Buschmann et al. | 340/286.05 |
| 7,202,613 | B2 * | 4/2007 | Morgan et al. | 315/312 |
| 7,388,514 | B1 * | 6/2008 | McDow | 340/907 |
| 7,423,548 | B2 * | 9/2008 | Kontovich | 340/691.1 |

* cited by examiner

*Primary Examiner*—Benjamin C Lee
*Assistant Examiner*—Lam P Pham
(74) *Attorney, Agent, or Firm*—Gerry J. Elman; Elman Technology Law, P.C.

(57) ABSTRACT

This invention pertains to evacuation systems, more particularly, it pertains to single or networked guiding devices that utilizing pre-programming and/or virtual programming, sensing and detecting means, illumination and alarming means, symbols and text messages to direct traffic to safety. The networked guiding devices of the system are configured to systematically and progressively direct traffic from one device to the next, directing traffic to safety. The system is configured to be controlled locally or remotely, on-demand. The evacuation system is applicable to people's traffic, vehicular traffic and/or other transportation modes. The evacuation system may be used in emergency or non-emergency situations.

15 Claims, 10 Drawing Sheets

A

B

C

D

PROGRAMMABLE, DIRECTING EVACUATION SYSTEMS: APPARATUS AND METHOD

CROSS REFERENCE TO RELATED APPLICATIONS

The present document claims the benefit of the earlier filing date of U.S. provisional patent application Ser. No. 60/680,027, filed in the U.S. Patent and Trademark Office on May 12, 2005, and U.S. provisional patent application Ser. No. 60/680,027 filed in the U.S. Patent and Trademark Office entitled "Emergency Lighting System" on Oct. 26, 2005, the entire contents of which is incorporated herein by reference.

BACKGROUND OF THE INVENTION

1. Technical Field

This invention pertains to the field of single or networked pre-programmable, evacuation guiding devices that form a system. More particularly, it pertains to single or networked guiding devices that utilizing pre-programming and/or virtual programming, sensing and detecting means, illumination and alarming means, symbols and text messages direct traffic to safety. The networked guiding devices of the system are configured to systematically and progressively direct traffic from one device to the next, directing traffic. The system is configured to be controlled manually, locally or remotely and on-demand; negating the time-consuming, trial-and-error method of finding one's way to safety. The evacuation system is applicable to people's traffic, vehicular traffic and/or other transportation modes. The evacuation system may be used in emergency or non-emergency situations.

2. Background of the Invention

Recent studies have shown that, in emergencies, evacuees directed to obstructed exit points or to too few exit points have created dangerous congestions. Similarly, evacuees have rushed to danger points sometimes leading to unnecessary death or vehicular traffic jams causing unnecessary destruction. Statistics related to asphyxiation from inhalation of lethal toxic gases, which may occur in minutes have indeed been a major factor as the indirect cause of death in a disaster situation. Sadly, many victims asphyxiated in unaffected sections of a structure occur a short distance from an available safe exit. Likewise, other evacuees have perished during confusing excursions into the unknown, unaware that they were being led towards, rather than away from danger.

The above situations have been made increasing more difficult for rescue workers, particularly with ever-more complex building structures, such as, multi-level underground parking structures and multi-level skyscrapers with many exit points, passageways and other evacuation points. For instance, in case of an emergency in a multi-level underground parking structure, with many ingress and egress ways, one exit point may be completely impassible because of sustained damage, or impassible because of the use by incoming emergency vehicles (i.e., fire engines, police cars, ambulances, etc.), or congested to the point that some traffic must be redirected to expedite the evacuation process.

The existing system of signs, even when clearly legible in an unpredictable disaster situation, can unfortunately direct evacuees unwittingly towards egress points which themselves may be part of a danger zone, or blocked and unavailable for exit to safety.

Various systems have recently been developed to guide and assist people in the case of an emergency. The purpose has sometimes been to indicate the exit door in a building, or guide the evacuees to follow a certain pathway along a corridor or hallway, to reach an exit door and egress. In other instances, signs have been used to indicate a predetermined direction to evacuate.

For example, WO 974,261,2A1 discloses a way-finding guidance evacuation system for disasters by the use of line of apparently moving electric lights, which automatically reverses direction on detecting heat or other danger This evacuation system only indicates two ways for evacuation and does not assist the evacuees if the system itself becomes damaged. Further, it cannot be remotely controlled.

U.S. Pat. No. 6,538,568 discloses a wireless emergency lighting monitoring and control system whereby a central control unit automatically schedules self-tests for each of the emergency lights, whereby failures are diagnosed and repairs are suggested. No provisions are made to relay any commands in evacuating pedestrians or vehicles from a structure.

U.S. Pat. No. 6,754,602 discloses a wireless (radio signals) emergency lighting system for a structural object such as a transportation vehicle. The evacuation system has multiple of emergency lighting assemblies, and each assembly in turn, has a microprocessor for controlling the operations of the emergency lighting component. The system also includes at least one control module for wireless interrogation of the multiplicity of discrete wireless emergency lighting assemblies. The system integrity maintenance is the ultimate goal and no provisions are made to direct traffic on demand.

WO 06018304A2 discloses a guidance and security system for complex mass transport systems that performs integrated passenger counting, security monitoring and controls trains and monitors tracks. The invention relates to guidance and security system for transport systems, in particular, complex mass transport systems, with integrated automatic passenger counting, security monitoring for vehicles, trains etc. The guidance systems are not in communication with each other and all commands originate from the control unit.

US 20050245232A1 discloses an emergency management and response mission support platform for emergency service providers, and provides real-time operational data such as location of emergency personnel, emergency response plan through web portal to user. The platform further facilitates communication between a plurality of emergency response and management organizations for further processing. The platform aids the management of an emergency, but does not guide evacuees.

U.S. Pat. No. 6,646,545 discloses a color-coded evacuation signaling system that uses LEDs to configure directing symbols and text messages, to guide evacuees to designated exits. The LEDs are formed into displays laid in the floor of a structure The system induces automatic dissemination of walking or crawling evacuees during an emergency, particularly in a smoke fog and low-light conditions, by guiding them away from deemed danger zones, then along assessed safe routes leading towards assessed safe designated exits. The system has no capability of being able to change direction in real time and assumes that the patrons are familiar with the color-coding.

US 20020015309A1 discloses an emergency lighting system for aircraft, has photoluminescent guide to identify escape route, photoluminescent indicator to identify exit, and photoluminescent sign to identify instructions and controls for opening exit. The system has no capability of being able to change direction in real time.

U.S. Pat. No. 6,763,624 discloses a sign apparatus for displaying a desired image on surface of wall by projecting the image onto an adjacent inclined surface to guide evacuees during an emergency.

U.S. Pat. No. 6,754,602 discloses a wireless emergency lighting system for an airplane, which includes multiple wireless lighting assemblies linked to one control unit and a diagnostic computer for assisting passengers to exit the vehicle in an emergency. Each emergency lighting assembly has means for receiving and transmitting radio signals. The control unit also has means for receiving and transmitting radio signals. The system cannot be commended in real time.

U.S. Pat. No. 6,472,994 discloses an emergency guidance system for use in multi-storied structures, which has exit indicators each of which has light emitting diode energized independently and is flexible enough to be formed into a roll and bend around corners. The guidance system is not preprogrammed to change direction and or change direction on command.

U.S. Pat. No. 6,249,221 discloses an emergency evacuation system used for assisting people to find exit door during emergency, has light source in door, which emits high intensity light on reception of alarm signal, to guide people to exit door. The alarm signal is received by a radio frequency receiver located in exit door that activates pulsating LEDs. The illuminating and flashing LED lights attract the attention of a person in distress who may be crawling along the floor in a smoke-filled room, therefore assisting people to locate and exit a smoke filled and burning enclosure.

U.S. Pat. No. 6,150,943 discloses a laser-based director for fire evacuation, which indicates safe passage through smoke-filled area by laser diodes set into floor and actuated in response to fire alarm sound. The images may comprise arrow indicators, graphics, or alphanumeric indicators.

U.S. Pat. No. 5,825,280 discloses a portable safety light and audible signal apparatus that has temperature sensor and wireless remote for production of one of three distinct audible tones to guide one or more fire fighters and emergency personnel to the exit during emergencies.

U.S. Pat. No. 5,612,665 discloses an escape route indication system, which provides specific information concerning emergency exits using profile strip in form of handrail on walls along path to be followed to a device such as a sign or sound system to aid in evacuation.

U.S. Pat. No. 5,611,163 discloses a direction indicator covers in the form of detachable chevron-shaped panels that fit within chevron-shaped apertures in the cover for emergency lighting systems. The direction of the chevrons can not be changed on demand.

U.S. Pat. No. 5,343,375 discloses an emergency egress illuminator and marker light strip which illuminate passageway during normal conditions and marks egress path along it during conditions of poor visibility.

U.S. Pat. No. 5,140,301 discloses a guidance method and apparatus for emergency evacuation which initiates oscillator to produce laser beam indicating direction of evacuation when an emergency has been detected.

U.S. Pat. No. 5,130,909 disclose an emergency lighting strip for pathways that comprises of spaced LEDs and incorporating prismatic or metal reflectors to guide evacuees during an emergency from a confined area with low visibility.

U.S. Pat. No. 4,347,499 discloses an emergency guidance system responsive to sensing means that determine the availability of an exit for use in the event of a catastrophe. The sensing means are electronically connected to control means capable of evaluating the input from the sensing means and dependent upon availability of exits cause discernible means to cycle sequentially through predetermined patterns dictated by the available exits. The discernible means can be visual, audible, or tactile.

U.S. Pat. No. 4,074,225 discloses an emergency detection alarm and evacuation system including a control panel with lighted indicators indicating actuation of respective fire-smoke detectors and exit signaling units. The control unit can be used to aid the building occupants to particular exit doors. Also disclosed is a closed circuit television system for visually monitoring the fire/smoke conditions in particular floor areas, for use in conjunction with said exit signaling units.

GB 2388693A1 discloses an emergency exit indicator that has an array of light emitting diodes which are activated by receiving an audible signal from a smoke or carbon monoxide detector.

EP1365369A1 discloses a light emitting device for warning and indicating an emergency exit having three illumination states, first a continuous illuminated state indicating normal condition, second a discontinuous illuminated state indicating an alert condition and third illuminated state indicating an emergency and dictating emergency evacuation.

EP 0679280B1 discloses an evacuation system using strip in form of handrail along path to be followed. The profile strip may consist of signs and/or light panels and/or sound devices and/or direction indicating components.

EP 0609170B1 discloses an emergency egress illuminator and marker light strip to illuminate passageway during normal conditions and marks egress path along it during conditions of poor visibility. The device consists of two strings of LEDs, in a transparent tubular housing, the first string is aimed at the middle of the passageway floor. The other strip is aimed at the exit point.

DE 4241862C2 discloses a system linked to central computer for managing emergency exit lighting and direction signs.

GB 2220288A discloses an emergency exit route detecting system configured to detect hazard conditions and selectively switch on indicator lights within areas to indicate condition of exit route.

CN 2230953Y discloses a mark light for emergency exits.

JP 52108792A2 discloses an evacuation guidance system using a plurality of indicating light sources to indicate a safe route.

JP 52083196A2 discloses an evacuation guidance system that uses different intensity of light for normal conditions—lower intensity—and emergency conditions—higher intensity.

JP 52083195A2 discloses a batter-operated evacuation system consisting of two direction-guiding lights by deactivating one of the guiding lights and activating the other.

JP 2003120011A2 discloses an emergency guiding system based on a baseboard having light emitting elements on printed circuit board, which emit light in direction of emergency exit during emergency conditions.

JP11203564A2 discloses an emergency guidance system that combines illumination and audio means to relay messages to trapped evacuees.

Japanese 52133792A2 discloses an evacuation guidance system for evacuation by changing arrows available in two directions only by turning off one of the arrows and intensifying the intensity of the arrow in the safe direction.

SUMMARY OF THE INVENTION

Essentially, the preferred networked system of the present invention consisting of the guiding devices systematically and progressively direct evacuees away from a danger zone to a safe zone. The system of guiding devices can be networked in a single structure (inter-networked) or networked in plurality of structures (intra-networked).

To improve the utility of the systems and guiding devices, different methods may be used. For example in one system, illumination and audio means and encrypted programming may be used in combination to provide instructions for the course and sequence of evacuation.

Additionally, detection means such as radio frequency identification nodes, smoke detectors, thermocouples, flame detectors, pressure sensors, global positioning systems and chemical analyzers among other means may be included with each embodiment to provide data for further processing and providing appropriate instructions.

It is noted that each method or device included in the embodiment or systems can be varied and can be used in different combinations. For instance, logic microprocessor device (LMD) and encrypted logical protocol programs can be used in the following manners: encrypted preprogrammed instructions embedded to direct traffic from one embodiment to the next in the same structure (inter-connected system of guiding devices) or in structures in close proximity (intra-connected systems and guiding devices). These preprogrammed instructions can be initiated by use of hard-wired connections or use of wireless means. The wireless means become essential, when the integrity of the electrical hard-wiring arrangement of a structure is compromised in a disaster. In addition, it may also be desirable to acquire data using wireless means for further analysis and to provide fast and precise information for further processing.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DETAILED DESCRIPTION OF THE PREFERRED EMBODIMENTS

Figure 1:
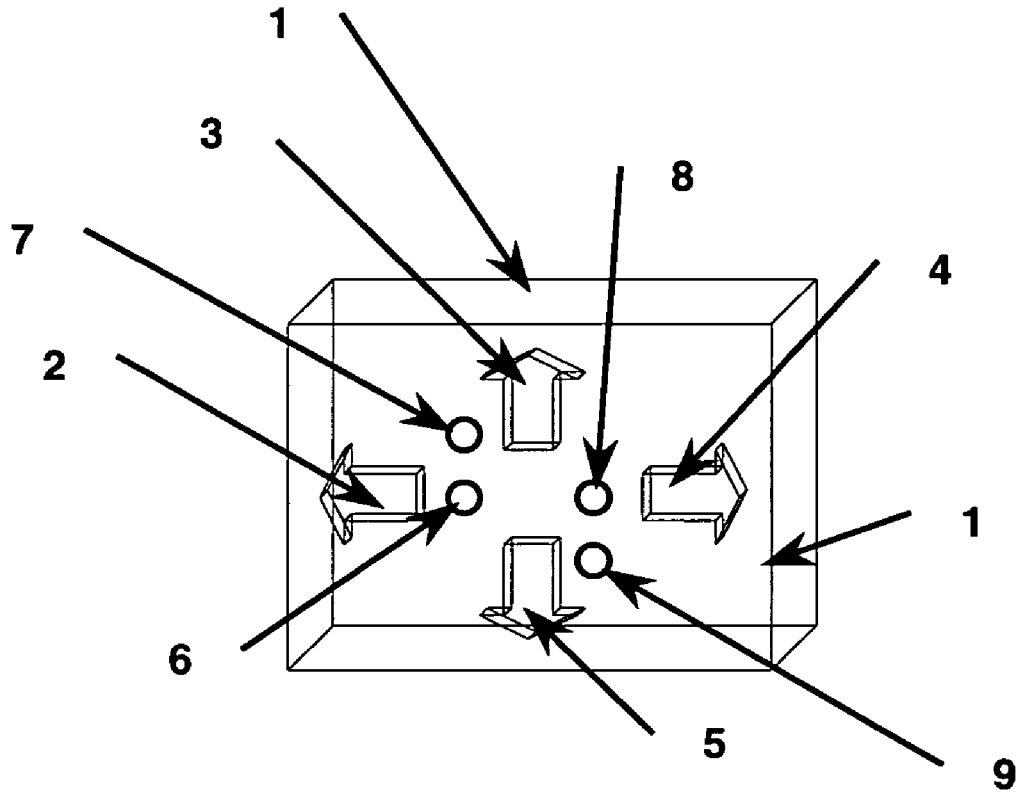
FIG. 1 is a simplified block diagram of one of the simplest devices according to the present invention.

Referring now to the drawings, preferred embodiments of the present invention are described.

Referring to the guiding device in FIG. 1, there is shown an guiding device 1 (i.e., a box) with four arrows 2 to 5 (e.g., arrows are cut out of the surface of the box), and manual electronic switches 6 to 9 corresponding to arrows 2 to 5 respectively. The switches 6 to 9 can be each manually operated to light up (e.g., lighting components or means, in this case LEDs not shown, has been located underneath each arrow in direct communication with the manual switch) the corresponding arrow directing traffic. The guiding device of FIG. 1 constitutes one of the simplest systems of the present invention.

Figure 2:
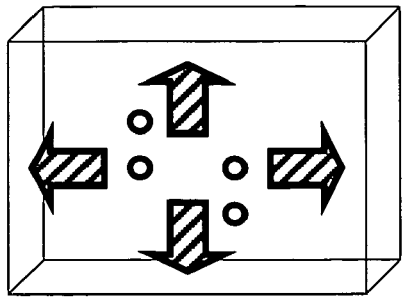
FIG. 2 is a block diagram illustrating the device in FIG. 1 in four different modes according to the present invention.
Figure 2:
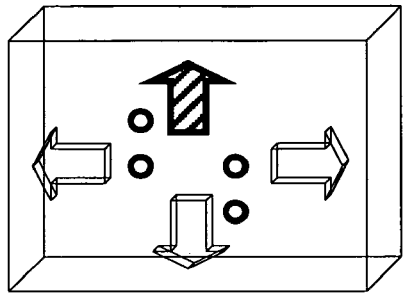
Figure 2:
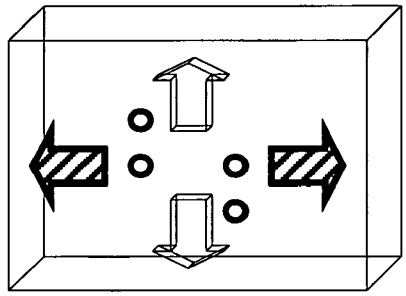
Figure 2:
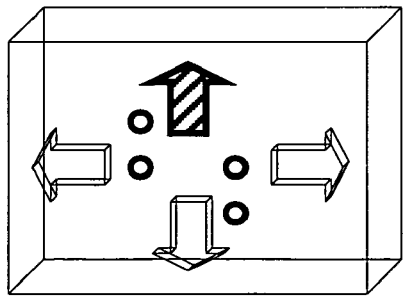

In a multi-level, underground parking structure, a plurality of guiding devices (e.g., 10s to 1000s) may constitute a system. The guiding devices are connected to a control center or control unit. Referring to FIG. 2, for example, four guiding devices of such a system is shown. These guiding devices are located at predetermined locations, for instance, the guiding devices may be attached to the supporting columns of the parking structure, using appropriate attachments (not shown). In a particular emergency or non-emergency situation, the traffic looking at the device A of FIG. 2 is directed to proceed in all directions, which is schematically illustrated by filled arrows—in effect, no direction is prohibited. The embodiment A is located at a particular area, where the arrow pointing upward means the traffic can proceed to the level above, the arrow pointing downwards means the traffic can proceed to the level below, and arrows pointing right and left mean the traffic can proceed in those directions respectively. As the traffic reaches the next device, B, of FIG. 2, it is directed to only to proceed to the above level, similarly device C of FIG. 2 directs traffic to left and right only, and device D only straight out of the parking structure.

Figure 3:
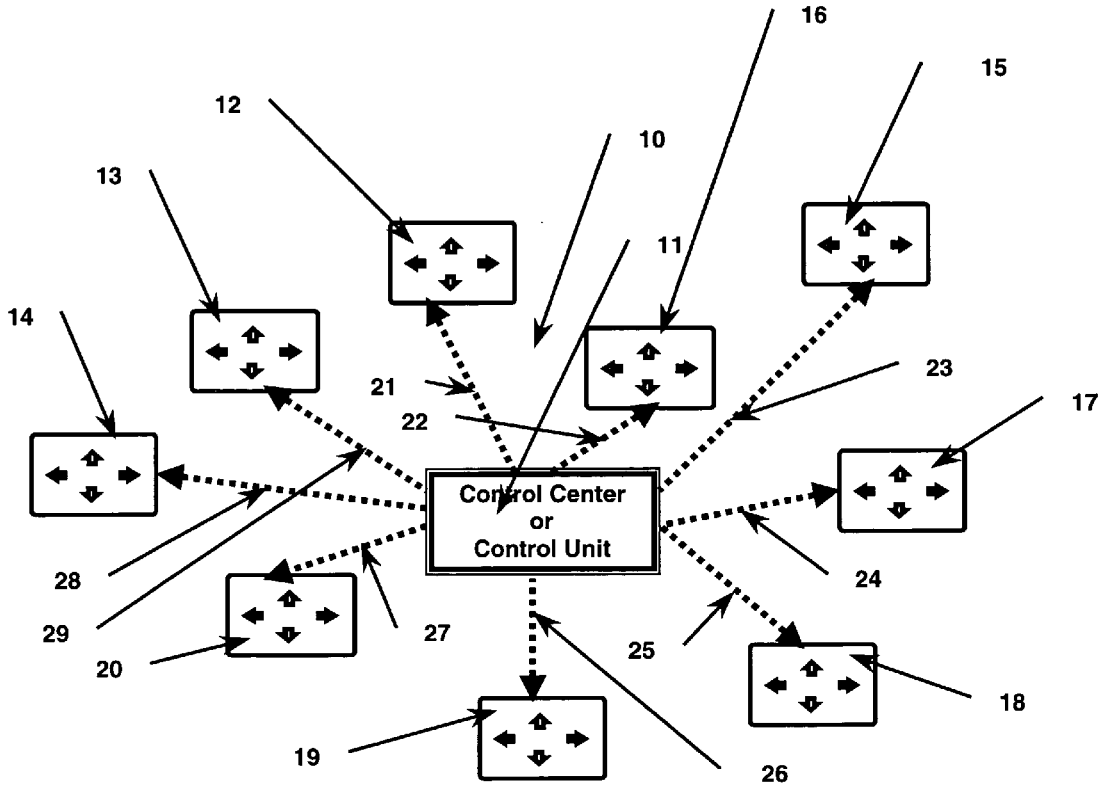
FIG. 3 is an illustration of networked system of the present invention whereby the guiding devices are in one-way communication with the control center or control unit according to the present invention.

Assuming that the guiding devices as shown in FIG. 1 are installed in the multi-level, underground parking structure as depicted above; in an emergency, there may not be enough time to configure a plurality of guiding devices manually—that is to turn many lighting components or means of guiding devices in a system. To facilitate this task, other measures are contemplated. For example, the guiding devices in addition to manual switches may include infrared detectors capable of receiving pre-programmed or virtual instructions instantly from a control center. Similarly, radio frequency may be used. To provide pre-programmed or virtual instructions to the guiding devices of a system; It is noted that the guiding devices can be configured to be hard-wired to the control center, or receive instructions via a wireless protocol. It is also noted that wireless communication between the control center and the guiding devices can be configured as a redundancy; that is, if the wire communication is in anyway interrupted, wireless communication is automatically activated to receive instructions. It is understood that the guiding devices in a system may also have some embedded pre-programmed instructions to direct traffic from one embodiment to the next and not all instructions have to be received from a control center. In system 10 of FIG. 3, the communication is one way from a control center 11 or control unit to the guiding devices 12 through 20. The guiding devices 12 through 20 in FIG. 3 are each in one-way communication via communication lines 21 through 29 with the control center 11.

In instances where the guiding devices are hard wired, DMX 512 protocol, which is based on digital communications between a central controller and the guiding devices, can be used. DMX 512 protocol was developed by the United States Institute of Theatre Technology ("USITT"). Basically, the DMX512 protocol consists of a stream of data, which can be communicated one-way from a control unit to the guiding devices using an Electronics Industry Association ("EIA") standard for multipoint communications know as RS-485.

Figure 4:
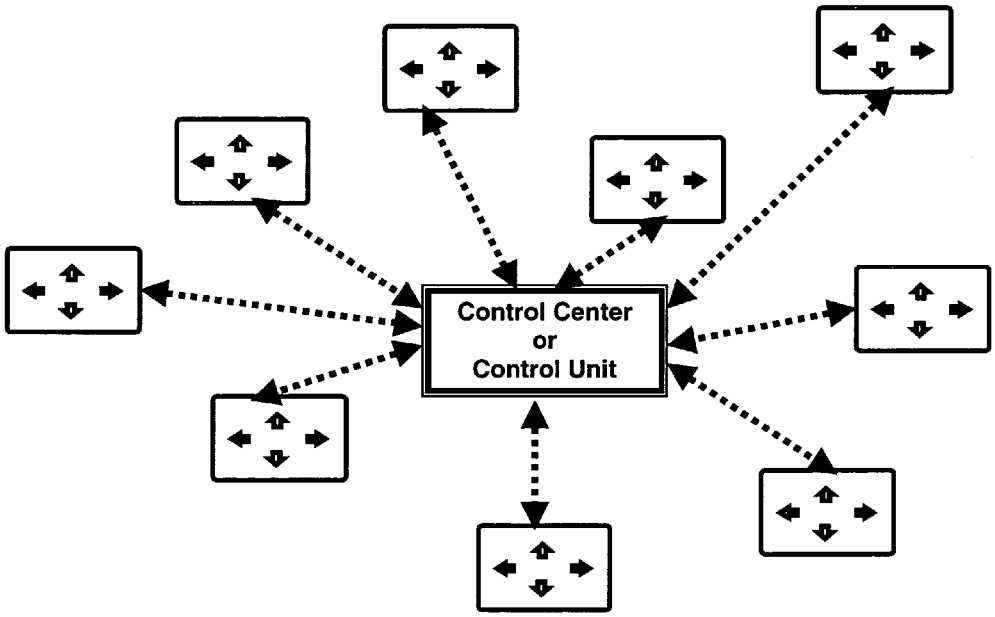
FIG. 4 is an illustration of networked system of the present invention whereby the guiding devices are in two-way communication with the control center or control unit according to the present invention.

In yet another aspect of the present invention, a networked system is configured in such a manner that the control center not only provides instructions to the guiding devices, but also receives data from the guiding devices in real time. In this manner, there is a two way communication established between the control center and the guiding devices. FIG. 4 refers to such a system. Considering that, the system in FIG. 4 is in every aspect the same as the system in FIG. 3, except that communication lines 21 through 29 are in two-way communication with the control center 11. The guiding devices of such a system in addition to having alarming components or means such as lighting components or means, sounding components or means, etc. also are fitted with sensors such as heat sensors, for instance, to detect a sudden change in temperature and relay the same to the control center in real time. It is noted that the guiding devices may be fitted with other sensors such as flame detectors based on ultraviolet to detect flame, pressure sensors to detect explosion, smoke detectors to detect smoke, chemical detectors to detect level of poisonous gas and the like. It is noted that the guiding devices may be fitted with any one or combination of detectors to relay the level of smoke, heat, gases such as CO2 and/or CO, temperature or other relative date to the control center or control unit. It is also noted that the data from any of the detectors can be relayed to the control center in real time or delayed, analyzed and then relayed. The incoming data may be processed and compared with pre-programmed safety parameters relating to the effects of parameters, specifically in regards to deemed survivable or non-survivable temperatures, visibility and air quality. This determines what areas of a structure are to be designated as danger zones or developing danger zones and consequently what areas require instantly updating or re-routing as escape go-routes or exits. For instance, a sudden outbreak of fire in a previously deemed survivable, if smoke filled 'go-route' routes leading towards one or more designated exits, would instantly be identified and allow the controllers to re-route the traffic on demand.

Additionally, the embedded programs and microprocessor in the guiding devices may be configured to analyze the data from more than one detector and then relay the analyzed data to the control center for further processing. It is noted that the guiding devices may also have some embedded pre-programmed instructions to direct traffic from one device to the next and not all instructions have to be received from the control center. It is also noted that the system may be configured to continuously provide virtual instructions to the guiding devices, and the devices provide in-time data as more data parameters become known to direct traffic from one device to the next. The virtual instructions and data can be relayed to the guiding devices and control center by use of hard-wired connections or use of wireless devices. It is noted that the control center may be located within the same structure or remote from the structure. It is also noted that protocols and other provisions may be provided to allow higher authorities, in the case of any damage to the local control center, control the guiding devices from a remote location such as from a remote control center miles away or from helicopter or a satellite.

The program embedded in the logic microprocessor devices (LMD) in the control center, can analyze the data received for cross-referencing to:

- where a structure's available exits are located
- where a structure's network of smoke, heat, poisonous gas or related detectors are located
- where the signaling system's own guiding devices are located in relation to exits and detectors
- which predetermined direction, guiding components or means to activate to facilitate the evacuation
- among analysis of other pertinent data.

The guiding devices may in addition to having means for receiving and transmitting data, have memory means for storing data for further analysis as abnormal situations develop.

Figure 5:
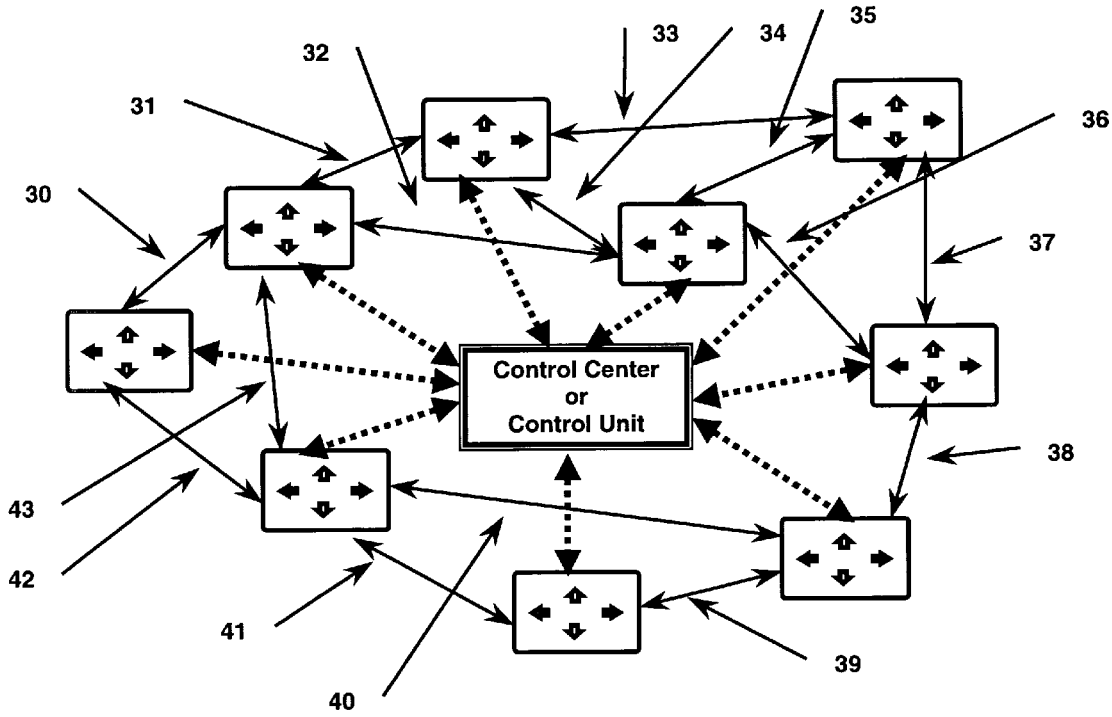
FIG. 5 is an illustration of networked system of the present invention whereby guiding devices are concurrently in two-way communication with the control center, and in two way communication between themselves (guiding devices) according to of the present invention.

In yet another aspect of the present invention, a networked system is configured in a manner that not only the control center provides instructions to the guiding devices and receives data from the guiding devices in real time; but also the guiding devices are in communication with each other. In this manner, there is "complete communication" established. This is similar to "mesh networking"—the mesh networking will be explored later. Similar to the systems disclosed before, the guiding devices of such a system may have illumination means, sounding means and the like, and have embedded sensors and detectors such as heat sensors, flame detectors, pressure sensors, smoke detectors, chemical analyzers and the like. It is noted that the guiding devices may be fitted with any one or combination of detectors, sensors or analyzers. It is also noted that the data from any of the detectors, sensors or analyzers can be relayed to the control center in real time or delayed, analyzed by the means integrated in the guiding devices and then relayed. Additionally, the embedded software and LMD in the guiding devices may be configured to analyze the data from more than one detector and then relay the analyzed data to the control center for further processing. It is noted that the guiding devices may also have some embedded pre-programmed instructions to direct traffic from one device to the next and not have all instructions received from a control center. It is also noted that the system may be configured to continuously provide virtual instructions to the guiding devices, and guiding devices provide in-time data as more data parameters become known to direct traffic from one device to the next. The virtual instructions and data can be relayed to the guiding devices and control center by use of hard-wired connections or use of wireless means. Such a configuration is schematically illustrated in FIG. 5. Considering that, the system in FIG. 5 is in every aspect the same as the system in FIG. 4, except that communication lines 30 through 43 provide two-way communication between the devices.

In instances where instructions are received from the control center by the guiding devices and data is relayed from the guiding devices to the control center (e.g., two-way communication); or where there is constant communication between the control center with the guiding devices and vice versa, and concurrently there is constant communication between the guiding devices (e.g., true networked communication); and, wireless communication is used as the primary methods of communication or as a back up redundancy; wireless mesh-networking technologies (protocols) such as Zig-Bee by Motorola of Schaumburg, Ill. USA and/or Z-Wave by Zensys Inc., Upper Saddle River, N.J. can be used for the implementation of the present invention. Mesh networking is a wireless technology that allows the guiding devices of the present invention to wirelessly connect together. There are many advantages to enabling such connectivity and forming a community mesh network between the guiding devices of a system. In a mesh-networked system, each wireless device becomes a routing node that is constantly in communication with all of the guiding devices in its immediate vicinity and can pass and receive data. The range depends on what kind of radio power levels and antenna design is utilized. For instance, in a mesh-networked system, the highest power level allowed, 200 mili Watts may be used in some municipalities. Such a high power level allows the guiding devices to be in communication with each other at ranges of up to 2,000 feet without being networked into a publicly used internet like the World Wide Web ("www").

In general, in a typical mesh-networked system of the present invention, guiding devices use complex algorithms to dynamically and automatically do discovery, routing and fast handoff of data as it becomes available. Guiding devices find each other and can route around failures and/or congestion (e.g., guiding devices that have become inoperable due to a disaster or catastrophe). In such a manner, multiple pathways are established between the guiding devices increasing the reliability of the evacuation system. Effectively, there is no single point of failure, as there is established a traditional hub-and-spoke network, negating the possibility of losing information due to a catastrophic situation. A mesh network immediately routes around a failure. That added reliability is especially important in large buildings and secured facilities.

Zig-Bee chips can, for instance, be embedded in the guiding devices of the present invention avoiding cabling cost, and with no wiring required, the guiding devices can be added anywhere, and moved easily. Zig-Bee or Z-Wave protocols have security features available within their definitions, and those features can be implemented within the guiding devices of the present invention.

Figure 6:
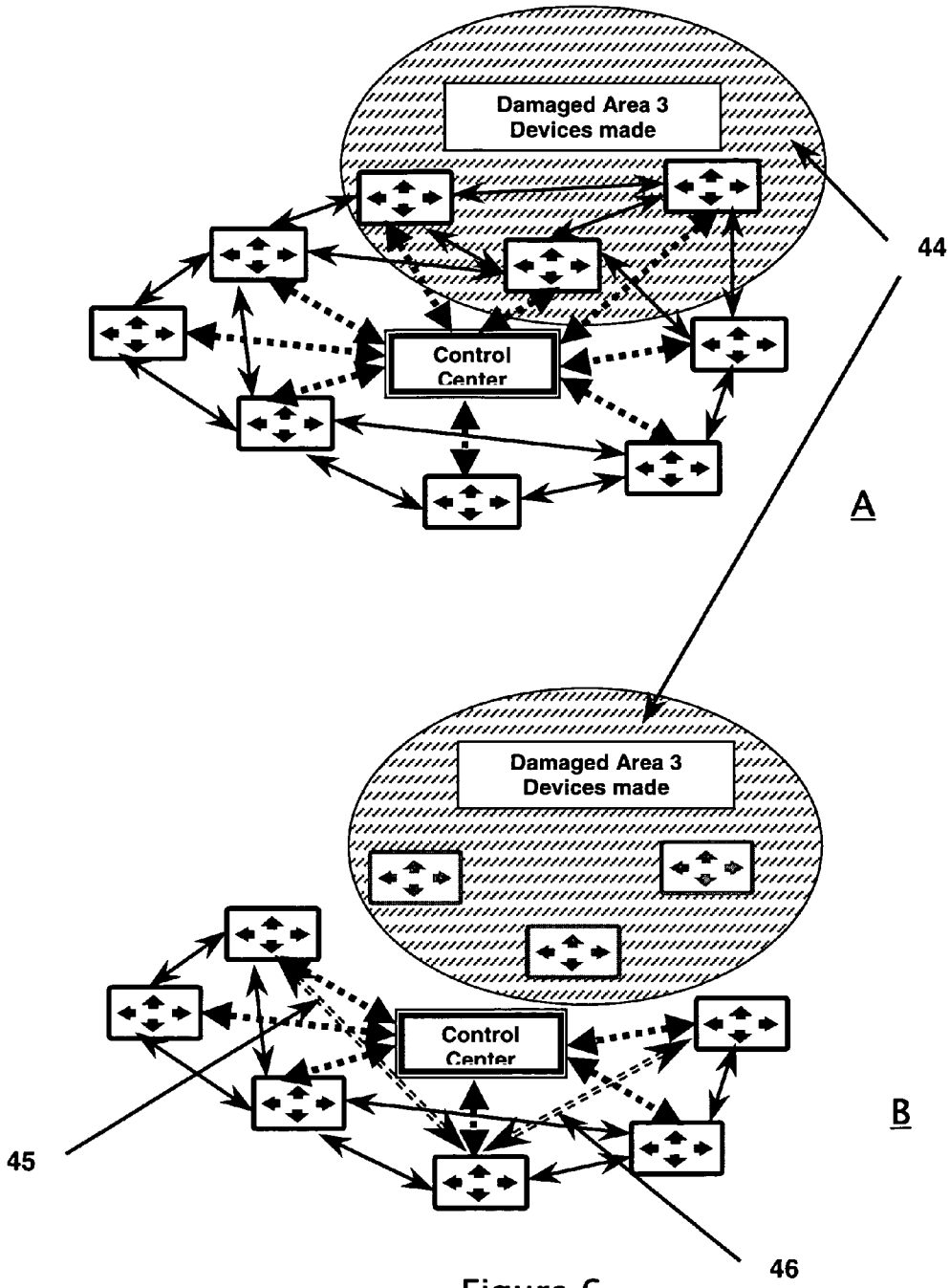
FIG. 6 is an illustration of networked system of the present invention in two different states. Circled area in FIG. 6 A represents a damaged area, and in FIG. B, the guiding devices in proximity of the damaged area illustrate the new lines of communication according to of the present invention.

By way of illustration, referring to FIG. 6 A, an area 44 of the system in FIG. 5 has been shown to has been damaged and guiding devices 12, 15 and 16 (see FIG. 3), communication lines 21, 22 and 23 between the guiding devices and the control center 11 (see FIG. 3), and communication lines 31 through 37 (see FIG. 5) have been made inoperable. Now referring to FIG. 6 B, the guiding devices 13 and 19 (see FIG. 3) have established communication via communication line 45. Similarly, guiding devices 17 and 19 (see FIG. 3) have established communication via communication line 46. The communication between the control center and the rest of devices, and communication between the rests of devices to devices remains intact.

The networked systems of the present invention disclosed thus far are autonomous systems—they each function within a single structure or venue (e.g., inter-connected). In yet another aspect of the present invention, autonomous systems from different venues can also be networked (e.g., intra-connected). For example, if there are multiple high rises in close proximity of each other, it is conceivable that in an emergency, the traffic directed out from one structure may conflict with the traffic from another structure creating disastrous results. It is contemplated that the control centers from the neighboring structures can be coordinated or pre-programmed to direct traffic to directions where congestion and conflict is not created at all, or, at least minimized.

Figure 7:
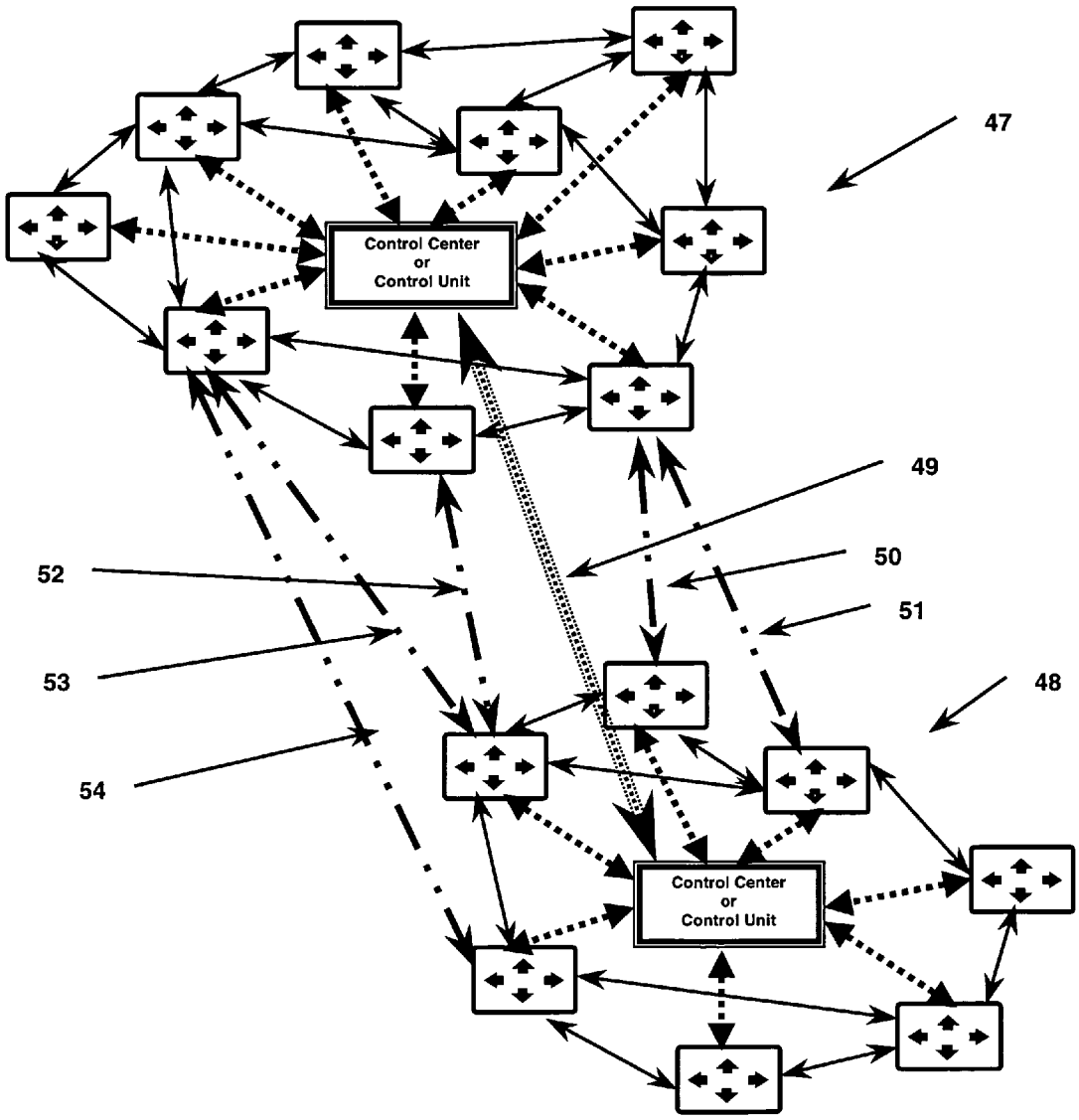
FIG. 7 is an illustration of intra-networked system of the present invention, where communication lines between control centers and guiding devices are schematically illustrated according to the present invention

Referring to FIG. 7, two networked systems 47 and 48 from two different venues are shown to be intra-networked according to the present invention. The control centers are in communication by communication line 49; and conversely, the guiding devices from the two networks are in communication by communication lines 50, 51, 52, 53 and 54. In this manner, two or more networked systems from different venues can provide instructions for evacuation.

Figure 8:
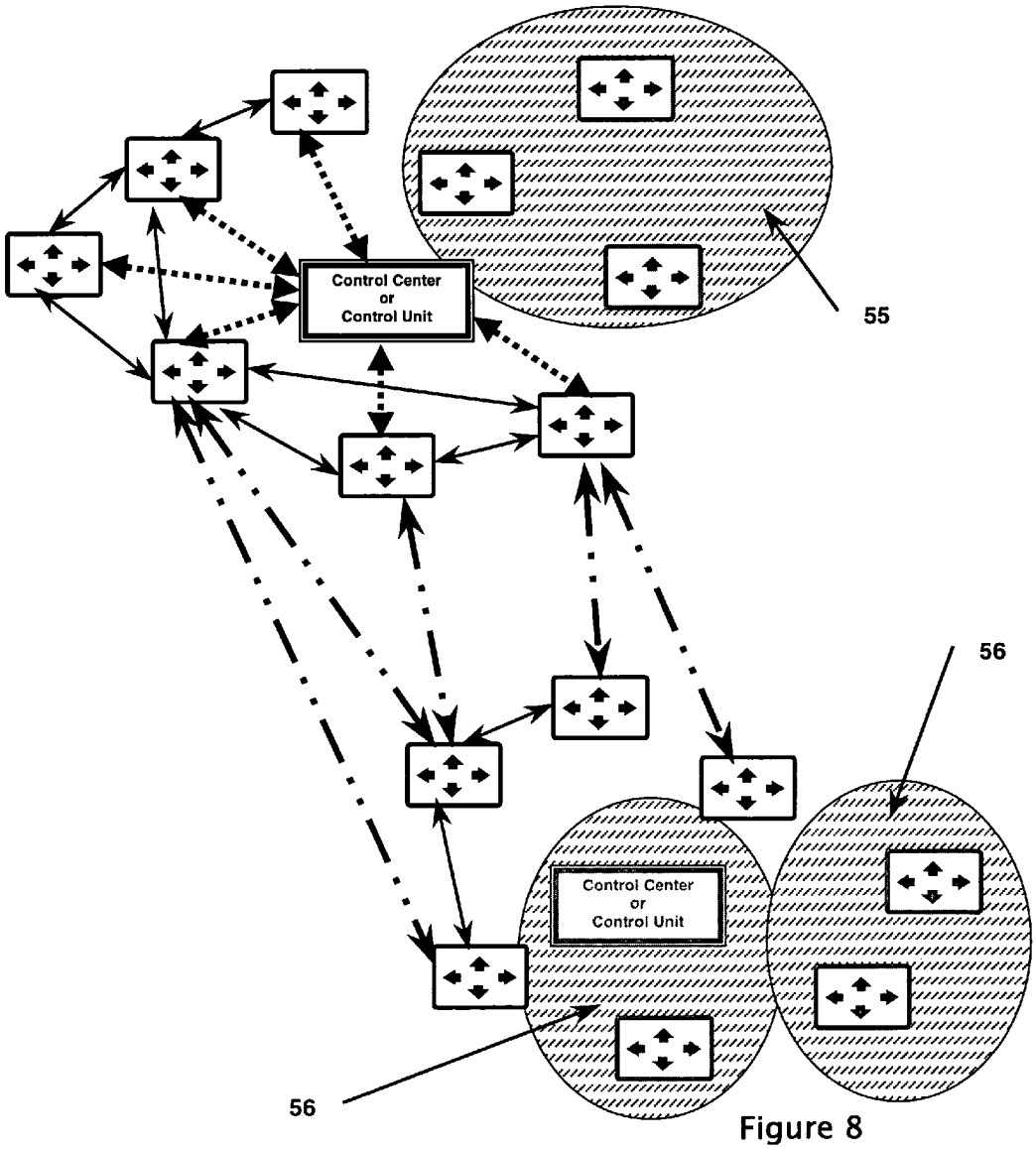
FIG. 8 is and illustration of the intra-networked system of FIG. 7, where areas of the networked systems have been damaged and made inoperable according to the present invention

It is noted that the intra-networked systems of the present invention similar to the inter-networked systems referred to in FIG. 6, would continue functioning through the embedded mesh-networking protocols even if a portion of networked system or more are damaged. Referring to FIG. 8, the two intra-networked systems of FIG. 7 are shown after a section of the networked system 47 has been damaged, area 55, and the guiding devices in this area have been made inoperable. The communication between the systems 47 and 48 will continue through the embedded mesh-networking protocols by communication lines 49 and 50 through 54. In like manner, if an area of system 48 has been damages as illustrated by area 56, the communication between the systems will continue through the embedded mesh-networking protocols by communication lines 49 and 50 through 54. Still in like manner, if the control center from one system has been made inoperable along with some of the guiding devices as illustrated by area 57 in FIG. 8, the undamaged sections of the systems will remain functional by the embedded mesh-networking protocols.

Figure 9:
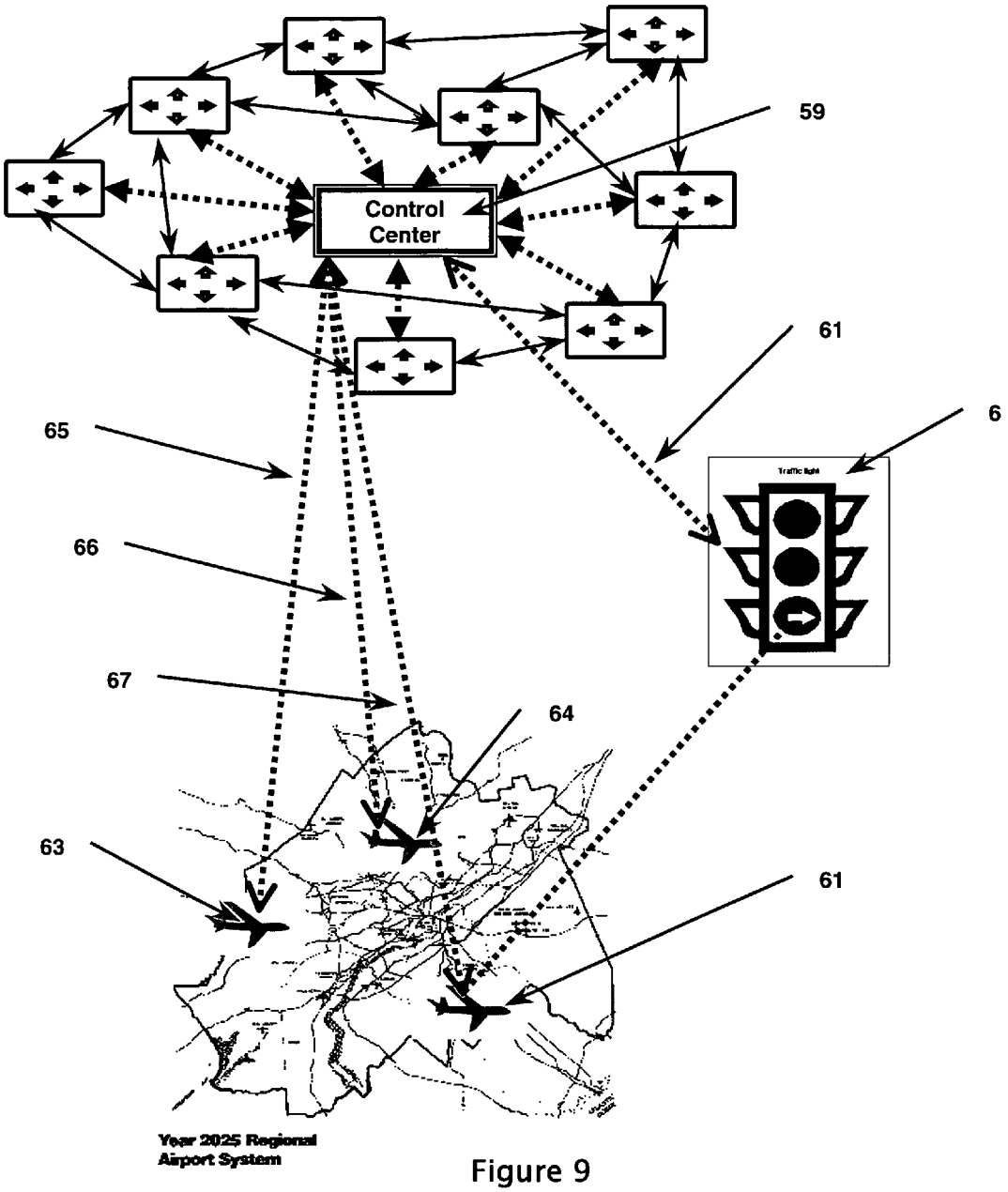
FIG. 9 is an illustration of network system where a network is established between a control center, a city's existing traffic light signals and airports according to the present invention.

In yet another aspect of the present invention, systems can be coordinated to operate with the traffic management systems of a city or municipality or controlling guiding devices at a remote location. It is conceivable that existing traffic lights at intersections can be directed and coordinated to by the central controls of the present invention and vice versa. FIG. 9 illustrates such a networked system. In FIG. 9, for instance, networked system 58 may be an emergency management center within a secure structure (i.e., Los Angeles Office of Emergency Management) for a large metropolitan. The control center 59 for networked system 58 not only controls the guiding devices of the system 58 residing in the emergency management center, but also controls traffic direction of traffic signal light 60 at a particular intersection in the city by communication line 61 to coordinate evacuation. It is noted that more than one traffic signal lights can be controlled for evacuation. Furthermore, the control center 59, in addition to controlling and providing instructions within the control center's structure, traffic signal lights at a plurality of intersections, can control guiding devices at airports 62, 63 and 64 at different locations many miles apart by communication lines 65, 66 and 67. It is also noted that the control center can receive data from any of these locations for further processing as mentioned before.

In general, and in reference to general aspects of the present invention, the LMDs embedded within guiding devices, control centers or units may be provided to receive instruction from a local inter-networked or intra-networked location within the local structure or remotely.

In yet another aspect of the present invention, the LMD preferably includes a microcontroller having changeable software. The LMDs may have certain fail-safes programmed embedded into it for verifying any new data received. These fail-safes include data encryption and password protection, as well as formulas for validating each device, control center or system integrity.

In yet another aspect of the present invention, the control center, the system and the corresponding guiding devices can use cell phones or the built-in cell networks to wirelessly communicate with each other.

It is noted that any single or combination of communications technologies may be used in the present invention.

System Options

It is noted that any light source can be used for the purposes of this invention; however, LEDs are preferred because LEDs are solid-state devices, have a long life, are energy efficient and compact among other benefits. It was further noted that because of the compactness of the LEDs, other auxiliary optic components, such as lenses, for example, to intensify and project light onto a surface, light tunnels, prisms, reflectors and refractors could easily be combined to intensify the light or make the light points easier to see. It is noted that, it may be desirable to use infrared LEDs to allow night vision or laser diodes to have better visibility in desired situations (i.e., smoked filled areas).

Figure 10:
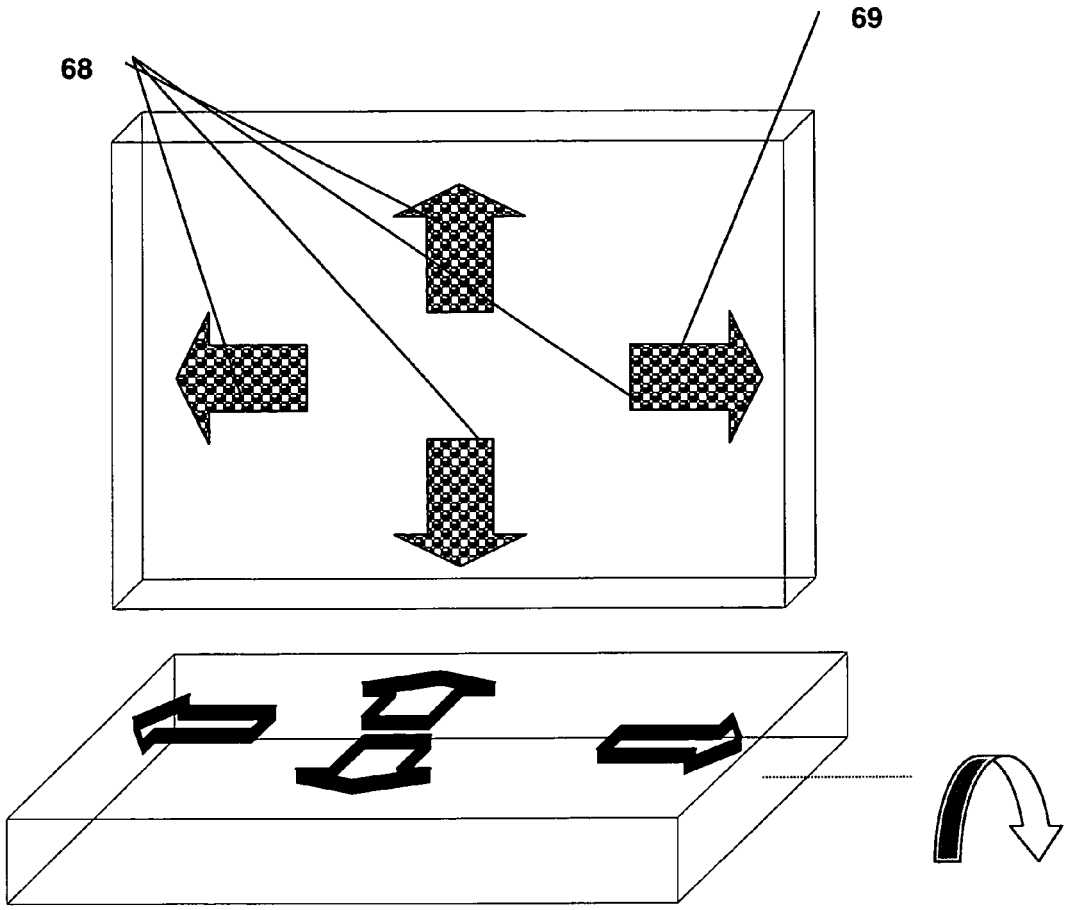
FIG. 10 is an illustration of a guiding device than the device in FIG. 1 according to the present invention.

In FIGS. 1 and 2, the arrows or chevrons are cut out from the surface of the enclosure, and replaced with clear window for the lighting means to shine through. It is noted that this arrangements is only a representation of the guiding devices of the present invention and the enclosures, arrows, lighting components and means, switches can be configured in other manners. For example, the lighting means (e.g., arrows, chevrons and other symbols) can be arranged using arrays of light emitting diodes (LEDs) 69 to resemble the shape of an arrow and can be placed on the top surface of the guiding devices' enclosures as sown in FIG. 10. FIG. 10 is a schematic representation of such an arrangement. The arrows when lit indicate the direction of free traffic: "it is OK to go this way". The direction of traffic can be pre-programmed to run in a predetermined pattern permanently or changed-on-demand during an emergency. The arrows further can be chasing, blinking or flashing.

It is noted that the dimensions or the shape or size of the arrows or chevrons are arbitrary and can be selected to suit the application. For example, for larger structures, larger guiding devices can be used, while smaller guiding devices can be used in other applications (i.e., corridors, hallways and the like).

It is noted that messages, symbols, codes, letters, communication insignia, emblems, motifs, logos, patterns, images, icons, figures among other representative means can be used individually or in combination for the purposes of the guiding devices of the present invention. Any required language or combination of languages may be used for the purposes of the guiding devices of the present invention.

It is noted that the shape, size and or materials of enclosure can be selected to suit the application. Metals, plastics, fire retardant compositions and any combinations with glass and ceramics among other materials can be used. The enclosure may be fabricated to be watertight, to withstand several hours of high temperature or withstand other environmental calamities as necessary.

It is noted that the electronic circuitry and LMD can be configured in such a way to cause the light means of the guiding devices to strobe, chase or blink depending on the application. Further, the commands and data transmitted and received can be controlled by manual switches, infrared frequency or radio frequency. The commands and data may be transmitted from a central location through hard wiring. The circuitry and LMD can be configured to accept commands from different sources if desired, or have provisions to allow the commands to be overridden by a higher authority. The circuitry and LMD may be predominantly analog or digital.

The power source can be high or low voltage AC in any part of a device or a system, although low voltage is preferred; and or be high or low voltage DC, whereby low voltage DC is preferred. The circuitry and LMD can be "hard-wired" to a power grid or use batteries to operate. Back-up batteries may be included to allow the system or any part of the system to operate in case the system is disconnected from the power grid. The battery can be rechargeable. It is noted that provisions can be made to allow the circuitry to switch from AC, hard-wired electricity to battery operated DC.

The guiding devices may be installed using appropriate fasteners for concrete surfaces such as underground parking structures (e.g., columns, ceilings, horizontal beams) or have an extension to be installed from a wall or ceiling in corridors and hallways. The guiding devices can also be configured to be installed on stands for easy installation and disassembly.

It is noted that the systems of the present invention may optionally have feed-back provisions embedded in the guiding devices to provide emergency personnel with an updated, time-identified schematic picture relating to the location, spread and nature of a disaster prior to them entering a structure. On activation, the provisions imbedded in the devices immediately relay the data provided such as level of smoke, poisonous gases, temperature or other relative parameters to the emergency personnel directly or via the control center. The incoming data is processed and compared with pre-programmed 'safety parameters' relating to the effects of parameters, specifically in regards to deemed survivable or non-survivable temperatures, visibility and air quality. This determines what areas of a structure are to be designated as developing danger zones, in order for the emergency personnel to take appropriate action.

Applications

The applications of the guiding devices or systems of the present invention for emergency evacuation and directing traffic include: office complexes, multi-level parking structures, public libraries, hospitals, healthcare facilities, hotels, theaters, superstores, shopping malls, airports, train stations, military facilities, ports passenger liners, oil-rig platforms, courtyards and building hallways among other venues.

It is noted that, many other modifications and variations of the present invention are possible in light of the above teachings. The specific devices and systems discussed herein are merely illustrative, and are not meant to limit the scope of the present invention in any manner. It is therefore to be understood that within the scope of the disclosed concept, the invention may be practiced otherwise than as specifically described.

I claim:

1. A guiding device for directing human or vehicular traffic comprising:

an enclosure with an upper visible surface with illumination symbols for emitting light through said upper visible surface;

an integrated circuitry and logic microprocessor device;

an embedded program;

wherein the embedded program contains instructions for the integrated circuitry and logic microprocessor device, which is in constant communication with illumination components, to selectively activate at least one illumination symbol and deactivate at least another illumination symbol to redirect traffic, and wherein the guiding device is in communication with multiple other such guiding devices on a data network and contains computer executable instructions for routing communications around one or more guiding devices on the network that are inoperative.

2. The guiding device of claim 1, wherein the embedded program contains instructions for the integrated circuitry and logic microprocessor device to selectively activate more than one illumination symbol and deactivates more than one illumination symbol to redirect traffic.

3. The guiding device of claim 1, further comprising a sensor for detecting heat, flames, explosions, smoke, or toxic chemicals.

4. A guidance system for directing human or vehicular traffic, comprising:

a control unit comprising integrated circuitry and a logic microprocessor device for sending instructions through a data network to at least one guiding device with illumination symbols for activating at least one illumination symbol and deactivating at least one other illumination symbol to direct traffic, wherein the at least one guiding device on the data network is in communication with multiple other such guiding devices on the network and contain computer executable instructions for routing communications around one or more devices on the network that are inoperative.

5. The guidance system of claim 4, wherein the logic microprocessor device contains computer executable instructions for receiving data from a sensor in communication with the data network, comparing the data to pre-programmed safety parameters for survivable and non-survivable temperatures, visibility, and air quality to determine if a corresponding area is a danger zone, and sending instructions to at least one guiding device corresponding to the danger zone to redirect traffic away from the danger zone.

6. The guidance system of claim 4, wherein the data network includes a cellular phone network.

7. The guidance system of claim 4, wherein devices on the data network are connected both wirelessly and by wire.

8. The guidance system of claim 7, wherein the communications through the wires of the data network are in the DMX 512 protocol.

9. The guidance system of claim 4, wherein at least one control unit is not in a structure containing guiding devices that it communicates with.

10. The guidance system of claim 4, wherein the at least one guiding device contains embedded pre-programmed instructions to direct traffic without receiving instructions from said control unit.

11. The guidance system of claim 4, wherein the at least one guiding device has a memory for storing data for further analysis when an abnormal situation develops.

12. The guidance system of claim 4, wherein said logic microprocessor device has computer executable instructions programmed into it for verifying any new data received, through data encryption or password protection.

13. The guidance system of claim 4, for a first structure, connected through a data network to a second guidance system of claim 4, for a neighboring second structure, wherein control units of the connected guidance systems contain computer executable instructions to coordinate with each other and direct traffic out of the two structures to prevent or minimize congestion and conflict.

14. The guidance system of claim 4, wherein the control unit is connected through a data network to a signal light for vehicular traffic in a city.

15. The guidance system of claim 4, wherein the control unit is connected through a data network to a guiding device at an airport.

* * * * *

UNITED STATES PATENT AND TRADEMARK OFFICE
Certificate

Patent No. 7,619,538 B1

Patented: November 17, 2009

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: James R. Zarian, Corona del Mar, CA (US); and Sheldon I. Ausman, Beverley Hills, CA (US).

Signed and Sealed this Twenty-first Day of September 2010.

Benjamin C. Lee
*Supervisory Patent Examiner*
Art Unit 2612
Technology Center 2600